US009340403B2

(12) United States Patent
Daly

(10) Patent No.: US 9,340,403 B2
(45) Date of Patent: May 17, 2016

(54) SYSTEM AND METHOD OF MANUAL CONTROL OF GASSES USED FOR SPOILAGE RETARDATION AND DISPENSING OF PERISHABLE POTABLE LIQUIDS SUCH AS WINE

(71) Applicant: Geoff Daly, Holland, MI (US)

(72) Inventor: Geoff Daly, Holland, MI (US)

( * ) Notice: Subject to any disclaimer, the term of this patent is extended or adjusted under 35 U.S.C. 154(b) by 0 days.

(21) Appl. No.: 13/869,229

(22) Filed: Apr. 24, 2013

(65) Prior Publication Data

US 2013/0277396 A1 Oct. 24, 2013

Related U.S. Application Data

(60) Provisional application No. 61/637,472, filed on Apr. 24, 2012.

(51) Int. Cl.

| | |
|---|---|
| ***B67D 1/08*** | (2006.01) |
| ***B67D 1/04*** | (2006.01) |
| *B67D 1/00* | (2006.01) |

(52) U.S. Cl.

CPC ..... *B67D 1/0437* (2013.01); *B67D 1/0082* (2013.01); *B67D 2001/0098* (2013.01); *B67D 2001/0481* (2013.01)

(58) Field of Classification Search

CPC .. B67D 2001/0475–2001/0493; B67D 1/0437; B67D 1/0412

USPC ..... 222/1, 400.7, 396–397, 399, 152; 137/212

See application file for complete search history.

(56) References Cited

U.S. PATENT DOCUMENTS

| | | | | | |
|---|---|---|---|---|---|
| 614,465 | A | * | 11/1898 | Habermann | 137/212 |
| 718,163 | A | * | 1/1903 | Sherrard | 222/82 |
| 1,056,394 | A | * | 3/1913 | Bernard-Schmolle | 222/396 |
| 2,079,049 | A | * | 5/1937 | St Clair | 215/4 |
| 2,189,643 | A | * | 2/1940 | Ward | 141/17 |
| 2,310,714 | A | * | 2/1943 | Slaughter | 222/400.7 |
| 2,388,026 | A | * | 10/1945 | Ward | 137/630.22 |
| 2,678,747 | A | * | 5/1954 | Caitung | 215/5 |
| 2,698,113 | A | * | 12/1954 | Linton | 222/83 |
| 2,842,293 | A | * | 7/1958 | Knapp et al. | 222/399 |
| 3,065,883 | A | * | 11/1962 | Nelson | 222/323 |
| 3,197,144 | A | * | 7/1965 | Kochner | 239/308 |
| 3,227,310 | A | * | 1/1966 | Farandatos | 222/5 |
| 3,679,104 | A | * | 7/1972 | Giroud | 222/396 |
| 3,863,673 | A | * | 2/1975 | Sitton | 137/614.11 |
| 3,883,043 | A | * | 5/1975 | Lane | 222/82 |
| 3,905,522 | A | * | 9/1975 | Johnston | 222/400.7 |
| 4,473,174 | A | * | 9/1984 | Heuser | 222/152 |
| 4,595,121 | A | * | 6/1986 | Schultz | 222/1 |
| 4,632,276 | A | * | 12/1986 | Makino | 222/80 |
| 4,674,662 | A | * | 6/1987 | Bergstrom et al. | 222/399 |
| 4,702,396 | A | * | 10/1987 | Gwiazda | 222/152 |
| 4,706,847 | A | * | 11/1987 | Sankey et al. | 222/1 |
| 4,850,387 | A | * | 7/1989 | Bassill | 137/212 |
| 4,934,543 | A | * | 6/1990 | Schmidt | 215/228 |
| 4,982,879 | A | * | 1/1991 | Corrado et al. | 222/400.7 |

(Continued)

*Primary Examiner* — Patrick M Buechner
*Assistant Examiner* — Randall Gruby
(74) *Attorney, Agent, or Firm* — Adam J. Cermak; Cermak Nakajima & McGowan LLP

(57) ABSTRACT

A method of preserving and controlling dispensed liquids is achieved exclusively and uniquely through operation of direct or indirect actuation of gas control valves acting systemically upon the liquid container and its contents so as to cause and control the flow of dispensed liquids held within the container.

15 Claims, 3 Drawing Sheets

(56) References Cited

U.S. PATENT DOCUMENTS

| | | | | | |
|---|---|---|---|---|---|
| 4,984,711 | A * | 1/1991 | Ellis | 222/82 |
| 5,022,565 | A * | 6/1991 | Sturman et al. | 222/396 |
| 5,139,179 | A * | 8/1992 | Cecil | 222/399 |
| 5,248,064 | A * | 9/1993 | Claycomb, Jr. | 222/95 |
| 5,395,012 | A * | 3/1995 | Grill et al. | 222/4 |
| 5,443,186 | A * | 8/1995 | Grill | 222/396 |
| 5,458,165 | A * | 10/1995 | Liebmann, Jr. | 141/64 |
| 5,465,875 | A * | 11/1995 | Garnett | 222/148 |
| 5,505,345 | A * | 4/1996 | Zeid | 222/402.1 |
| 5,586,588 | A * | 12/1996 | Knox | 141/285 |
| 5,635,232 | A * | 6/1997 | Wallace | 426/397 |
| 5,667,110 | A * | 9/1997 | McCann et al. | 222/386.5 |
| 6,658,859 | B2 * | 12/2003 | Phelps et al. | 62/3.6 |
| 6,789,698 | B2 * | 9/2004 | Gloor et al. | 222/5 |
| 7,287,670 | B2 * | 10/2007 | Yoshida et al. | 222/1 |
| 7,712,637 | B2 * | 5/2010 | Lambrecht | 222/400.7 |
| 7,896,203 | B2 * | 3/2011 | Myron | 222/401 |
| 8,033,431 | B2 * | 10/2011 | Sommerfield et al. | 222/152 |
| 8,196,783 | B2 * | 6/2012 | Krzecki | 222/394 |
| 8,371,478 | B2 * | 2/2013 | Sommerfield et al. | 222/152 |
| 8,453,888 | B2 * | 6/2013 | Sommerfield et al. | 222/399 |
| 8,496,139 | B2 * | 7/2013 | Nishino | 222/91 |
| 8,636,179 | B2 * | 1/2014 | Menard et al. | 222/442 |
| 8,640,919 | B2 * | 2/2014 | Lambrecht | 222/82 |
| 8,967,435 | B2 * | 3/2015 | Nyambi et al. | 222/399 |
| 2003/0177912 | A1 * | 9/2003 | McGuire et al. | 99/323 |
| 2007/0181601 | A1 * | 8/2007 | Daly | 222/152 |
| 2007/0233567 | A1 * | 10/2007 | Daly | 705/14 |
| 2009/0224000 | A1 * | 9/2009 | Lopez et al. | 222/152 |
| 2009/0283553 | A1 * | 11/2009 | Hoss et al. | 222/396 |
| 2010/0006603 | A1 * | 1/2010 | Weinberg et al. | 222/152 |
| 2010/0015568 | A1 * | 1/2010 | Carron et al. | 433/130 |
| 2010/0155419 | A1 * | 6/2010 | Nishino | 222/81 |
| 2011/0204093 | A1 * | 8/2011 | Lee | 222/152 |
| 2012/0074175 | A1 * | 3/2012 | Krzecki | 222/394 |
| 2012/0285998 | A1 * | 11/2012 | Peirsman et al. | 222/396 |
| 2013/0017304 | A1 * | 1/2013 | Gormley et al. | 426/477 |
| 2013/0306673 | A1 * | 11/2013 | Manera | 222/82 |
| 2014/0252023 | A1 * | 9/2014 | Taylor | 222/1 |
| 2014/0252046 | A1 * | 9/2014 | Rider et al. | 222/399 |
| 2014/0319179 | A1 * | 10/2014 | Bazoberry | 222/152 |

* cited by examiner

SYSTEM AND METHOD OF MANUAL CONTROL OF GASSES USED FOR SPOILAGE RETARDATION AND DISPENSING OF PERISHABLE POTABLE LIQUIDS SUCH AS WINE

This application claims priority under 35 U.S.C. §119 to U.S. Provisional App. No. 61/637,472, filed 24 Apr. 2012, by Geoff Daly, the entirety of which is incorporated by reference herein.

BACKGROUND

1. Field of Endeavor

The present invention relates to devices, systems, and processes useful for dispensing wine, and more specifically to dispensing wine from a bottle using pressurized, inert gas.

2. Brief Description of the Related Art

This invention applies to the field of wine preservation and dispensing equipment used for wine sampling and wine-by-the-glass service from opened bottles of wine as applicable in commercial and consumer use.

Post-bottling wine spoilage is most often the result of sorption of the 21% oxygen component in ordinary air following wine's exposure to that air after opening and during pouring cycles. Numerous methods have been used to address issues of wine spoilage after bottle opening. Notable among these are partial vacuum and low-pressure, sealed inert gas systems of varying effect and complexity. Under their premises, both methods require complete bottle sealing to maintain the negative or positive pressures of their systems. Such sealing often requires complex assemblies and operation. Successful use of these methods is highly dependent on the operator's skill and attention to bottle seal placements.

The invention can resolve common operating problems users experience with constantly-pressurized, inert gas wine preservation systems using variably-designed bottle interfaces or bottle sealing mechanisms. A high occurrence of improperly sealed wine bottles leads to unexpected preservation gas losses—leakage—caused by malfunction, wear, and operator error. Because the gas pressure in these systems serves dual functions, both as an oxygenated-air displacer and as a propellant, driving wine from the bottle, the consequences of unexpected gas supply depletion can be catastrophic. Prior systems' wine dispensing utility will not function until replacement inert gas supplies are connected when available. In typical control valve and seal configurations of such equipment, the common failure to make a proper seal at only a single bottle, can result in total gas loss-and consequent system shut-down-within four hours. Often such equipment includes an array of four to twenty bottles, each with its own seal-leak potential. In these system configurations, when properly sealed, control of the pressurized gas is merely an indirect, secondary result of direct-acting liquid control valve operation; that is, the opening of a valve causes wine to flow from the bottle, and the resulting increase in bottle headspace is filled with gas from the gas supply system, which is always in fluid communication with that headspace.

Acknowledging this common problem, some prior art, such as ProWine Products n2-Infinity models, has incorporated synchronous, electronically-controlled gas loss prevention circuitry referenced above, the assurances offered by such systems comes at a high cost, often unaffordable for many restaurants, bars, package shops, and wineries.

SUMMARY

According to a first aspect of the invention, a method of dispensing wine from a bottle containing the wine, the bottle including a headspace above the wine and a bottle neck, comprises sealing the bottle neck, a dispensing tube extending out of the bottle neck, when the headspace is at atmospheric pressure, pressurizing the headspace with an inert gas, said pressurizing causing wine in the bottle to flow up and out of the dispensing tube, and venting the headspace to atmosphere while maintaining a seal of the bottle neck and while wine remains in the bottle.

According to another aspect of the present invention, a wine bottle interface useful for dispensing wine from the wine bottle comprises a head having a lumen and a separate gas channel, a tube extending through the head and not in direct fluid communication with the gas channel, the gas channel extending from outside the head and fluidly parallel to a portion of the tube, and a three-way valve fluidly connected to the gas channel, wherein the valve includes a fluid inlet, and first and second fluid outlets, the first fluid outlet being in fluid communication with the gas channel and the second fluid outlet being in fluid communication with atmosphere.

Still other aspects, features, and attendant advantages of the present invention will become apparent to those skilled in the art from a reading of the following detailed description of embodiments constructed in accordance therewith, taken in conjunction with the accompanying drawings.

BRIEF DESCRIPTION OF THE DRAWINGS

The invention of the present application will now be described in more detail with reference to exemplary embodiments of the apparatus and method, given only by way of example, and with reference to the accompanying drawings, in which.

DETAILED DESCRIPTION OF EXEMPLARY EMBODIMENTS

Figure 1:
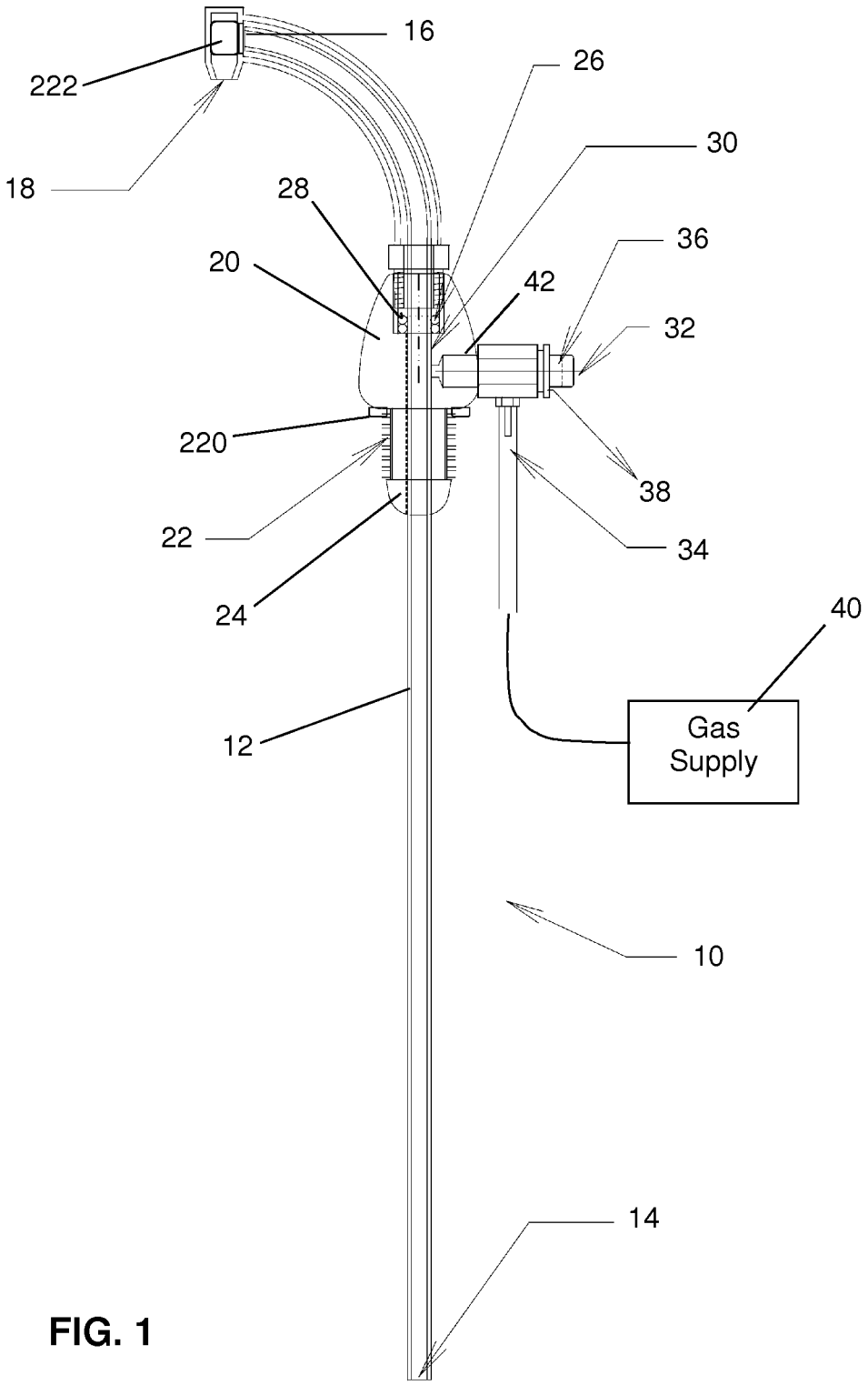
FIG. 1 illustrates a longitudinal cross-sectional view of an exemplary system useful for executing methods of the present invention.

Referring to the drawing figures, like reference numerals designate identical or corresponding elements throughout the several figures.

The singular forms "a," "an," and "the" include plural referents unless the context clearly dictates otherwise. Thus, for example, reference to "a solvent" includes reference to one or more of such solvents, and reference to "the dispersant" includes reference to one or more of such dispersants.

Concentrations, amounts, and other numerical data may be presented herein in a range format. It is to be understood that such range format is used merely for convenience and brevity and should be interpreted flexibly to include not only the numerical values explicitly recited as the limits of the range, but also to include all the individual numerical values or sub-ranges encompassed within that range as if each numerical value and sub-range is explicitly recited.

For example, a range of 1 to 5 should be interpreted to include not only the explicitly recited limits of 1 and 5, but also to include individual values such as 2, 2.7, 3.6, 4.2, and sub-ranges such as 1-2.5, 1.8-3.2, 2.6-4.9, etc. This interpretation should apply regardless of the breadth of the range or the characteristic being described, and also applies to open-ended ranges reciting only one end point, such as "greater than 25," or "less than 10."

Methods and systems embodying principles of the present invention can offer a new operational paradigm of assurance against unexpected gas loss due to component wear and common operator errors through lower cost, manual control methods. Obversely, they utilize momentary-acting, manually-controlled gas valves to control individual bottle gas flow before entering the headspace of normally non-pressurized bottles. Liquid flow control in this method becomes a secondary result of the direct-acting gas control mechanism; that is, gas control to the bottle headspace is primarily controlled, and secondarily, wine is dispensed.

Due to the engineering characteristics of the gas valves in this configuration, bottle headspace pressures will normalize to atmosphere when reverted to idle at the end of the dispensing cycle. Systemic gas flow is controlled directly and willfully by the operator actuating and de-actuating the valve, with the result that gas will not inadvertently flow until the valve is intentionally re-actuated for further dispensing. Thus, wine preservation and dispensing systems using this direct gas control method are afforded previously unavailable assurances against accidental gas losses resulting from common operating errors.

As an adjunct benefit, because bottle headspaces are not constantly pressurized, the risk of forced gas absorption in wine is minimized, making the application less sensitive to the type of gasses used for oxygenated air displacement. This leads to markedly greater convenience in the use of such systems through the elimination of the need for specialty gasses. For example, carbon dioxide, which, under constant pressure, will readily dissolve into wine—carbonating it—is on-premises in nearly all hospitality environments for soft drink service. The short burst of momentarily-pressurized $CO_2$ for wine dispensing utilizing this method will not carbonate the wine, as it would in the constantly-pressurized environments of conventional inert gas preservation and dispensing methods.

In addition, because the methods and systems described herein eliminate typical continuous pressurization of bottle head spaces, the bottle interface can be simplified to offer comparative cost reductions while promoting ease and speed of operation. Direct-acting, manually-controlled gas valves incorporating a depressurizing function activated at the end of each dispensing cycle, according to some embodiments, are preferably used. The pressure relief function of the valve may be manually actuated, or automatically actuated by mechanical devices, such as springs. Thus, systems and methods as described herein can include the use of pressure relieving valves in principle for inert gas preservation and dispensing applications without dependency on the specific valve design, and can include the delivery of an inert gas to a bottle interface incorporating gas inlet and outlet ports, and wine inlet and outlet ports, without dependency on the design of the interface or the nature of the gas delivered.

The valve system portion of the bottle interface provides three stages of operation: OFF—the resting stage, not actuated; ON—Actuation—the active, intentional dispensing stage; and DEPRESSURIZING—the temporal, post-dispensing stage before resuming the resting (OFF) stage. Features of the valve system include: a pressurized gas inlet port admitting gas from a supply source through a bottle interface to a bottle; and a pressure relief port from the bottle through the bottle interface to atmosphere. These features may be integrated into a single valve assembly, as illustrated in the accompanying, representative drawings, or may be accomplished in multiple-component assemblies. In either case, the two functions of pressurization and depressurization are integral to the system and combined in methods in accordance with principles of the present invention. Indeed, simple and well-known two- or three-hole bottle stoppers can be used, with appropriate tubing and valves attached to each hole, could be used in a very simple embodiment. In the methods and systems described herein, the inert gas acts both as an oxygen-displacing preservative and propellant for dispensing the contained liquid, such as wine, per industry conventions.

Distinct from the convention in wine dispensing, is that, in the methods and systems described herein, dispensing of the liquid is controlled not by the conventional, direct-acting liquid control valve, but an indirectly-acting gas control valve (or valves) which sequentially (1) supplies pressurized gasses into the container while dispensing and then (2) closes the gas supply and relieves container pressure to end dispensing. Also among the unique distinctions of these methods and systems, is the provision of direct and intentional operator's manual control of the supply gasses with subsequent, immediate container pressure relief to create a preservation and dispensing system that is not critically reliant upon constant, high-integrity, failure-prone sealing at the container to prevent accidental gas losses, which commonly plague the industry's conventional designs and intentions of maintaining continuously pressurized systems.

A further distinction arises from the unique and intentional de-pressurized, idle state of the liquid container. This depressurization eliminates the potential for pressure-induced, forced absorption of the preservation-dispensing gasses into the contained liquid at the risk of altering sensory characteristics of taste and smell. Absent forced pressure absorption potentials, the system is able to expand the selection of inert or non-reactive gasses—conventionally limited to specially-procured, high-pressure Nitrogen or Argon cylinders—to include carbon-dioxide ($CO_2$) gas as generally pre-existent in restaurants and bars for soft drink and soda service, adding to simplicity and market appeal.

An example of a single, multi-function, two-position (off/on) valve schematic is shown and described in the accompanying figures, wherein by initially pressing an actuator button, or 'switching' a correlative toggle actuator, pressurized gas from a first gas path—from the supply—is admitted into the connected container at a second path—a wine bottle X. Secondarily, releasing that button or toggle closes the gas supply from the first path, while simultaneously and automatically relieving or vacating pressure in the container from the second path to ambient air space at a third path to end dispensing.

Alternatively, two standard two-way valves may be used to accomplish the same functions. In this exemplary embodiment, one normally-closed valve is actuated to supply pressurized gas and end that supply to the container. The other, normally-closed valve is then actuated to relieve or vacate pressure in the container.

Similarly, the same functions can be integrated into a single, three-position valve fitted with a lever or toggle actuator presenting:

1. a normally-closed 'neutral' position when not actuated, in which supply gas is blocked from the first path to the second path, and from the second path to the third path.

2. an open, ON position, admitting gas from the first path to the second path 2, when actuated in one direction.

3. an open, ON position vacating gas from the second path to the third path, when actuated in another direction of the valve.

Figure 2:
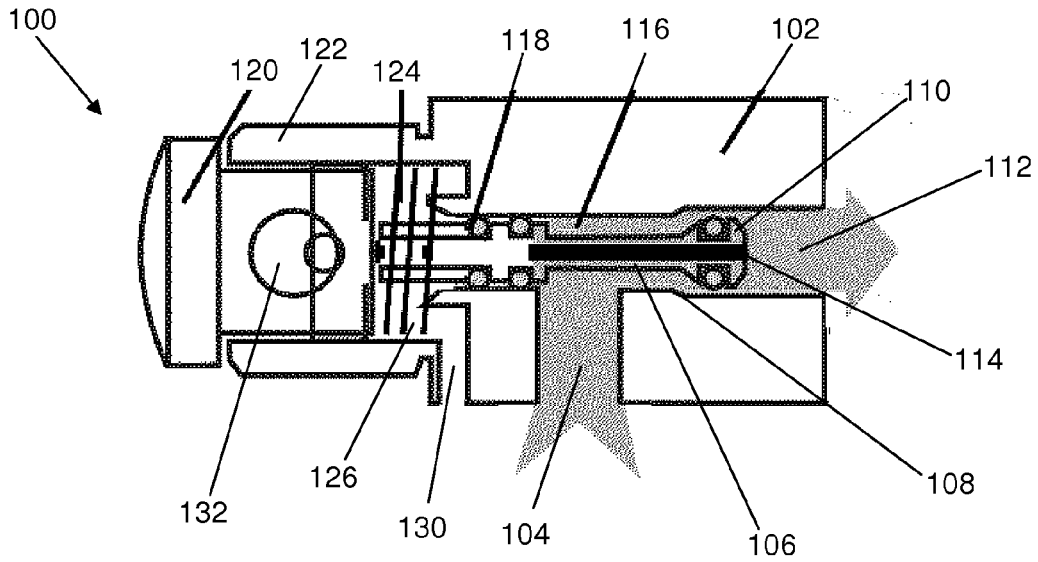
FIGS. 2 and 3 illustrate cross-sectional views of an exemplary valve body.
Figure 3:
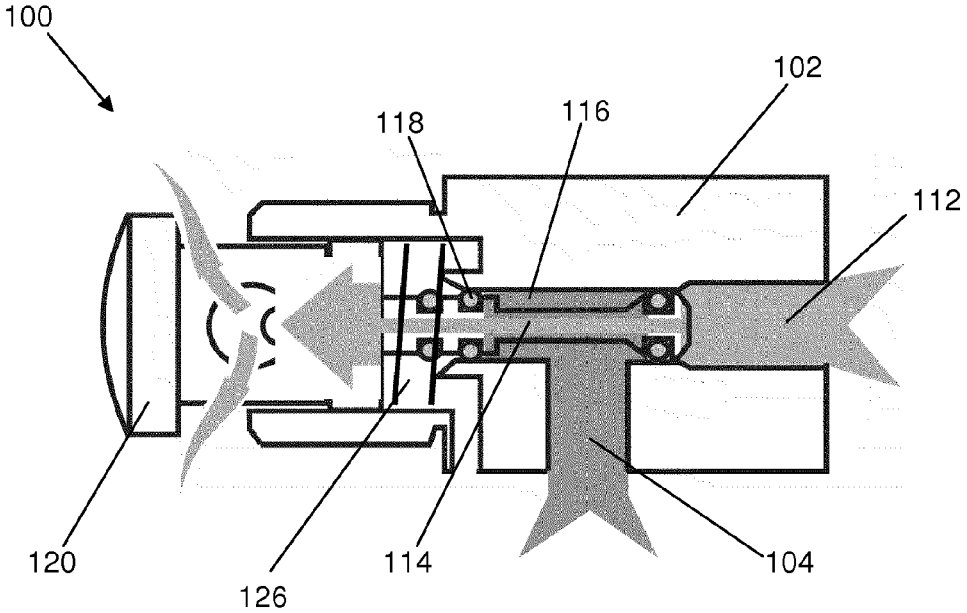

A preferred embodiment is the single, multi-function valve as described herein with reference to FIGS. 1-3. However, because the objectives of this unique preservation-dispensing method can be accomplished by multiple single-function valves or alternative single valves incorporating the same functions, such alternative configurations are contemplated within the scope of the present invention. Additionally, while the drawing figures show an example of a directly-mounted control valve, it must be recognized that identical operation can be achieved when the valve or valves are connected to the bottle via a length of tubing—a mere extension of valve placement facilitating other configurations of the same preservation and dispensing gas control method.

Exemplary, currently commercially available valves can be used in methods and devices embodying principles of the present invention. By way of non-limiting examples, a Pneumadyne S11-1880 (Pneumadyne, Inc., North Plymouth, Minn.), and a Man Valve PB3NC-B,1/8M,R FLOW, B (Marr P/N 329690) (Marr Valve Co., Granite Falls, Minn.), are examples of available three-way valves that can be used.

Turning now back to the drawing figures, FIG. 1 illustrates a cross-sectional view of an exemplary bottle interface 10 which can be used in the performance of methods as described herein. The interface 10 includes a liquid (wine) inlet tube 12 which has a bottom end 14 and a top end 16, with a lumen extending between the ends; the tube 12 can be formed of a single, unitary piece, or multiple pieces fluidly connected together. A liquid outlet 18 is optionally attached to the top end 16, from which dispensed liquid, e.g., wine, can flow.

A head 20 is positioned along the tube 12, and includes a gas and liquid friction seal 22 on the outside of an extension 24, which is sized to be received in and fluidly seal against the neck of a wine bottle. The top of the head 20 includes bore 28 in which a seal 26 is provided around the tube 12, so that pressurized gas that is present in the bore 28 does not escape from the head, while wine can flow upwardly in the tube 12 and out of the interface 10. According to one embodiment, the tube 12 is not itself valved, as the flow of wine through the tube is secondarily controlled by the fluid pressure in the headspace above the level of the wine in the bottle (see FIG. 4), which is in turn controlled by the user of the device. This is opposite to the conventional constructions, in which a valve directly controls the flow of the wine through a dispensing tube, while the headspace above the wine in the bottle is continuously (re-)pressurized with a gas (typically, an inert gas). Optionally, the tube 12 can include a one-way check valve 222, e.g., a spring-loaded ball valve, duckbill valve, or the like, which permits wine to flow only out of the bottle, and inhibits or prevents backflow of wine or air back into the bottle through the tube 12. Such a valve is advantageously positioned at or very close to the liquid outlet 18, so that a minimum of wine residue in the tube 12 is exposed to ambient air downstream of the valve.

The head 20 includes a gas channel 30 which fluidly communicates along the exterior of the tube 12 and along the extension 24 with the interior of the bottle. Such a gas channel 30 can be any of numerous configurations, including one or more entirely separate lumens through the head 20, or one or more channels cut into the head and extension alongside the tube 12, or one or more channels cut into the exterior surface of the tube 12 (while not directly fluidly communicating with its lumen), or one or more separate lumens in the tube 12, or combinations of these.

A three-way valve 32 is fluidly attached to a sideport 42 formed in the head 20, the sideport being in fluid communication or otherwise leading to the gas channel 30. As discussed elsewhere herein, the valve 32 can take on numerous configurations, so long as it can perform the functions of pressurizing and depressurizing the bottle headspace as described herein. Furthermore, while somewhat less preferred, a pair of two-way valves can be used in the instead of a three-way valve: one to pressurize the headspace, and one to vent the headspace to atmosphere, i.e., to depressurize the headspace. In the exemplary embodiment illustrated in FIG. 1, the valve 32 includes a pressurized gas inlet port 34, which is in fluid communication with a source 40 of pressurized inert gas (e.g., $CO_2$, $N_2$, Ar, air, and mixtures thereof). The valve 34 includes a pressure relief port 36 formed in the valve, which can take any of numerous configurations, so that gas 38 can exit from the valve and depressurize the headspace in the bottle. In the exemplary embodiment illustrated herein, the port 36 is formed in or along part of the valve actuator, but other locations are also contemplated.

FIGS. 2 and 3 illustrate cross-sectional views of an exemplary valve 100, similar in many respects to valve 32, which can be used to pressurize and depressurize the headspace in a bottle, and thus secondarily force liquid (wine) from the bottle for dispensing. The valve 100 includes a valve body 102 having an inlet passage 104 configured to be connected to a source of pressurized gas, e.g., source 40. A hollow valve stem 106 is positioned in the body 102, such that it is (linearly) movable to seal and unseal a valve seat 108 with an O-ring bearing valve head 110. The valve head 110 thus selectively fluidly communicates the inlet 104, via a channel 116, with a first outlet 112, which is in fluid communication with the bottle headspace; that is, using the exemplary interface 10, the first outlet 112 can be attached to the head 20 at side port 42.

The valve 100 includes an always-open fluid flow passage that permits backflow of pressurized gas to a second outlet, thus permitting venting of the bottle headspace to atmosphere. In the exemplary embodiment of FIGS. 2 and 3, this passage is formed as an always-open lumen 114 in the valve stem 106, extending entirely through the head and stem, and to at least one point beyond seals 118 on the end of the stem opposite the head and on the other side of the inlet 104.

The valve 100 includes an actuator for the valve. In the illustrated exemplary embodiment, a pushbutton 120 is used; alternatively, a toggle switch or other, similar configuration can be used. The pushbutton 120 is partially contained in a hollow collar 122, which captures a (coil, disc, or leaf) spring 124 in the hollow space 126 between the pushbutton and the rest of the valve body 102. Formed in any of the pushbutton 120, the collar 122, or the valve body 102, the second gas outlet is formed, through which pressurized gas from the bottle headspace escapes. By way of non-limiting examples, the second gas outlet can include one or more of side vents 130 in the body 102, passages 132 formed in the pushbutton 120, side vents formed in the collar 122, each fluidly communicating the space 126 with the exterior of the valve and to atmosphere. The right, interior-facing portion of the pushbutton, when pushed against the force of the spring 124, is attached to the leftmost portion of the valve stem 106, pushing the valve stem to the right and into the configuration illustrated in FIG. 2. Because of the lumen 114, a small amount of pressurized gas will, in this exemplary valve, flow out of the second outlet, but not enough to prevent wine from being dispensed.

With reference to FIG. 3, when the pushbutton is released by the user, the spring 124 forces the pushbutton and the valve stem to the left, into the configuration illustrated in FIG. 3, causing the seals 110, 118 to fluidly isolate the inlet 104 from the space 126 and the first outlet 112, while permitting fluid to flow (from right to left) from the inlet 112, through the lumen 114, out of the valve stem, and out of the second outlet (132, 130, etc.). Alternatively, in a more automated version, the pushbutton 120 can be actuated by, or form a portion of, a linear actuator which is itself controlled by electronics. In this manner, the valve functions to temporarily admit pressurized gas into the headspace of a connected bottle, and then quickly depressurize that headspace. These steps are then repeated until the wine in the bottle is entirely (or nearly entirely) dispensed, with the headspace being alternatingly pressurized and depressurized.

Figure 4:
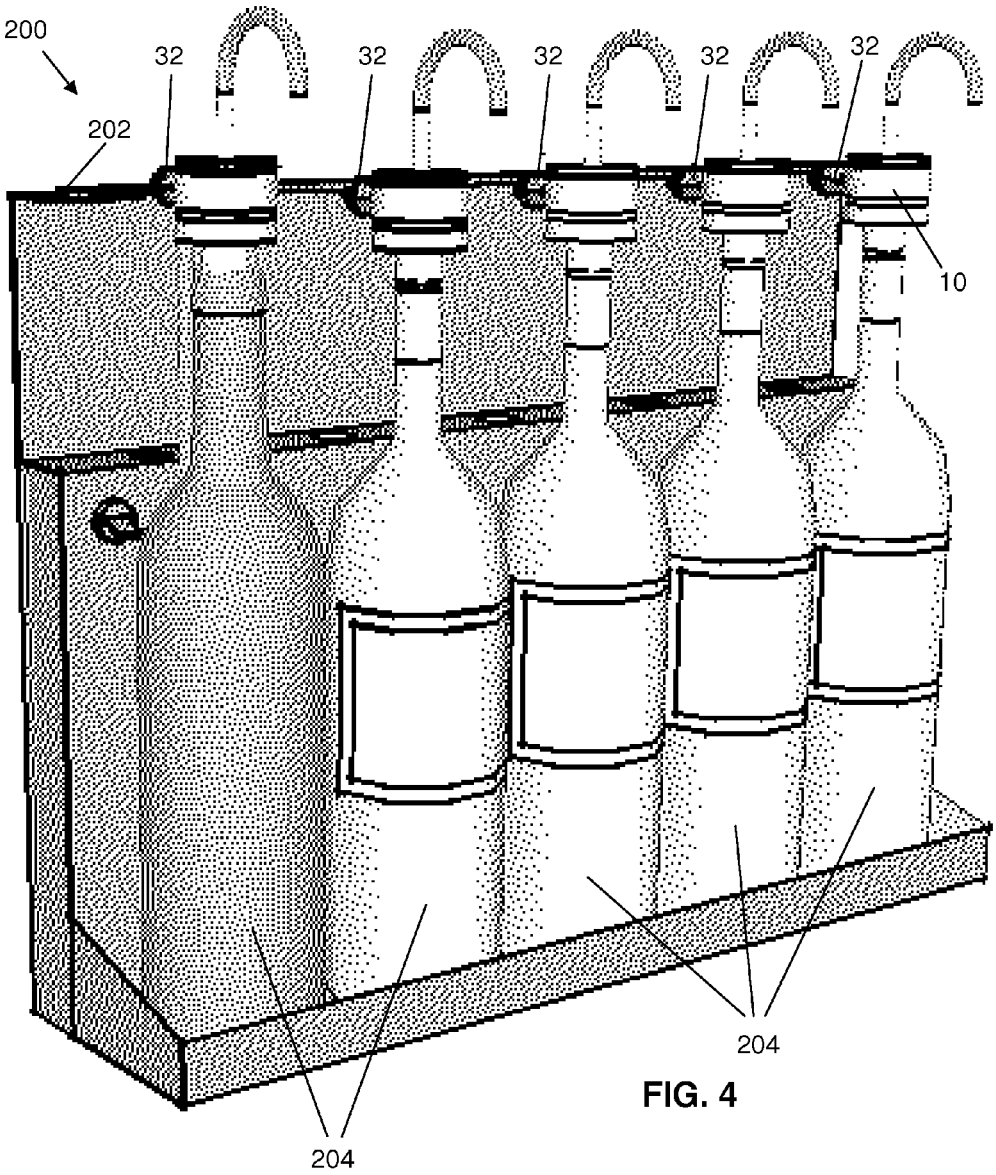
FIG. 4 illustrates a perspective view of an exemplary system.

FIG. 4 illustrates an exemplary implementation, in which a system 200 includes a rack 202 holding a plurality (here, five) wine bottles 204 including wine therein, in the neck of each of which bottles a bottle interface 10 is sealingly positioned. Each of the interfaces 10 is connected to a source of gas (e.g., 40), as described elsewhere herein, which preferably is the same for all of the interfaces, or can be separate sources.

According to yet another exemplary embodiment, the bottle interface's head can be secured to the exterior of the bottle neck, e.g., using the external threads that are now commonplace on wine bottles, or by the use of a compression seal. For this exemplary, alternative head, an abutment seal 220(see FIG. 1) is positioned at the top edge of the bottle neck, and an internally threaded collar, rotatably positioned at the bottom of the head, is threaded onto the bottle neck, compressing the abutment seal against the top surface of the bottle neck and sealing the head to the bottle. Exemplary abutment seals are included in, e.g., a ProWine Screwtop Adapter (Prowine Products, 4269 Lincoln Road, Suite 200, Holland, Mich. 49423).

While the invention has been described in detail with reference to exemplary embodiments thereof, it will be apparent to one skilled in the art that various changes can be made, and equivalents employed, without departing from the scope of the invention. The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments as are suited to the particular use contemplated. It is intended that the scope of the invention be defined by the claims appended hereto, and their equivalents. The entirety of each of the aforementioned documents is incorporated by reference herein.

I claim:

1. A method of dispensing wine from a bottle containing the wine, the bottle including a headspace above the wine and a bottle neck, the method comprising:

sealing the bottle neck, a dispensing tube extending out of the bottle neck;

when the headspace is at atmospheric pressure, pressurizing the headspace with an inert gas, said pressurizing causing wine in the bottle to flow up and out of the dispensing tube, and during said pressurizing, an entrance to a vent channel allows fluid communication between the bottle and the vent channel; and venting the headspace to atmosphere while maintaining a seal of the bottle neck and while wine remains in the bottle, said venting being performed until said headspace is at atmospheric pressure.

2. A method according to claim 1, wherein sealing comprises sealing with a head that at least partially extends into the bottle neck.

3. A method according to claim 2, wherein pressurizing comprises admitting pressurized inert gas through said head into the headspace.

4. A method according to claim 3, wherein venting comprises venting pressurized gas in the headspace through said head.

5. A method according to claim 1, wherein sealing comprises sealing with a head only at a top surface of the bottle neck.

6. A method according to claim 1, wherein said dispensing tube does not include a valve.

7. A method according to claim 1, further comprising:

inhibiting backflow of fluid into said bottle through said dispensing tube.

8. A method according to claim 1, wherein pressurizing comprises:

opening a valve having a fluid inlet, a first fluid outlet, and a second fluid outlet, such that pressurized gas flows through the fluid inlet and out the first fluid outlet without flowing out the second fluid outlet.

9. A method according to claim 1, wherein venting comprises:

closing a valve having a fluid inlet, a first fluid outlet, and a second fluid outlet, such that pressurized gas flows from the bottle, back through the first fluid outlet, and out the second fluid outlet, without flowing out the fluid inlet.

10. A method according to claim 1, wherein said inert gas is $CO_2$.

11. A method according to claim 1, wherein said venting the headspace is performed immediately after said pressurizing the headspace.

12. A wine bottle interface useful for dispensing wine from the wine bottle, the interface comprising:

a head having a lumen extending therethrough, and a separate gas channel;

a tube extending through the lumen and not in direct fluid communication with the gas channel, the gas channel extending from outside the head and fluidly parallel to a portion of the tube; and a three-way valve fluidly connected to the gas channel;

wherein the three-way valve includes a fluid inlet, first and second fluid outlets, and an an always-open vent channel, the first fluid outlet being in fluid communication with the gas channel and the second fluid outlet being in fluid communication with atmosphere;

wherein the always-open vent channel fluidly connects the first and second fluid outlets.

13. A wine dispensing system comprising:

a wine bottle having a neck and containing wine; and a wine bottle interface according to claim 12 fluidly sealing against the wine bottle neck.

14. A wine dispensing system according to claim 13, further comprising:

a source of pressurized inert gas in fluid communication with the valve fluid inlet.

15. A wine dispensing system according to claim 14, wherein said inert gas is selected from the group consisting of $CO_2$, $N_2$, Ar, air, and mixtures thereof.

* * * * *